US006057029A

United States Patent [19]

Demestre et al.

[11] Patent Number: 6,057,029

[45] Date of Patent: May 2, 2000

[54] PROTECTIVE WINDOW SHIELD FOR BLAST MITIGATION

[75] Inventors: Eugene J. Demestre, Richmond; Kenneth M. White, Alexandria; T. Jameson Stott, Richmond, all of Va.

[73] Assignee: Virginia Iron and Metal Co., Richmond, Va.

[21] Appl. No.: 09/057,711

[22] Filed: Apr. 6, 1998

Related U.S. Application Data

[60] Provisional application No. 60/059,029, Sep. 16, 1997.

[51] Int. Cl.[7] ..... F41H 1/02

[52] U.S. Cl. ..... 428/221; 160/120; 428/911; 442/1; 442/135

[58] Field of Search ..... 442/59, 135, 1; 428/911, 221; 160/23.1, 120, 121.1, 241

[56] References Cited

U.S. PATENT DOCUMENTS 5,466,503 11/1995 Dischler ..... 428/911 X
5,589,254 12/1996 Dischler ..... 428/221
5,595,809 1/1997 Dischler ..... 428/113

OTHER PUBLICATIONS

"Strength of a Diamond in a Fiber," Allied Signal Spectra Performance Materials, Allied Signal, Inc., 6 pp.

*Primary Examiner*—Henry F. Epstein
*Attorney, Agent, or Firm*—Greenberg Traurig; Richard E. Kurtz

[57] ABSTRACT

A blast protecting panel for interior portions of building windows includes a blast-shielding panel of a high tensile fiber woven in an open weave fabric in such a manner whereby a high degree of light is transmitted through the fabric while still allowing see-through visibility. The fabric is mounted using a retention system, which can be either fixed or dynamic, allowing the fabric to unwind and billow out into the building, retaining flying glass and debris. The retention system preferably includes fixed upper and dynamic lower tension retainers around which a length of fabric is wound and which allows the fabric to unwind therefrom without becoming detached from the retainer case or from the surface to which the retainers are mounted.

7 Claims, 7 Drawing Sheets

PROTECTIVE WINDOW SHIELD FOR BLAST MITIGATION

This application relates to, and claims the benefit of U.S. Provisional Application Serial No. 60/059,029, filed Sep. 16, 1997, the entire disclosure of which, including subject matter incorporated therein by reference, is incorporated herein.

BACKGROUND OF THE INVENTION

1. Field of the Invention

The invention relates in general to devices for protecting buildings from the hazardous effects of exterior explosive blasts and certain natural disasters, and in particular to a protective shield which can be applied to window or other portions of a building for mitigating the effects of exploding or shattered glass and flying debris.

2. Related Art

In exterior explosions and certain natural disasters, a high percentage of injuries and damage are caused by flying debris, particularly from glass and particles from the windows of a building.

Attempts have been made to address this issue. One method is to apply protective film to the window. This reduces the amount of flying glass and debris, but can result in larger pieces of glass and film that still cause injury and damage. Films have a relatively short life cycle, and are subject to UV degradation that causes breakdown in the film and in its adhesives. There are also anchoring problems involved with thicker films and laminates.

Another method involves installing blast curtains at window areas. These blast curtains, however, can be rendered ineffective to potential danger by drawing them open. Furthermore, in most embodiments, extra fabric is stored in a bottom container below the interior side of the window, which is unsightly and collects dust and dirt, requiring periodic cleaning.

Another method involves the use of strong laminated glass at window openings. The strength requirements of the framing around such units are considerable, as the frame must be able to withstand at least as much load as the laminated unit to prevent the unit from becoming detached from the building structure in the event of an explosion. In both new construction and retrofit situations, such framing is very costly.

These and other drawbacks exist in prior methods and apparatuses for blast mitigation.

SUMMARY OF THE INVENTION

In a preferred embodiment, the invention provides a blast protecting panel which is comprised of a high tensile fiber woven in an open weave fabric in such a manner whereby a high degree of light is transmitted through the fabric while still allowing see-through visibility. The fabric is mounted using a retention system, which can be either fixed or dynamic, allowing the fabric to unwind and billow out into the building, retaining flying glass and debris. The retention system preferably includes fixed upper and dynamic lower tension retainers around which a length of fabric is wound and which allows the fabric to unwind therefrom without becoming detached from the retainer case or from the surface to which the retainers are mounted.

BRIEF DESCRIPTION OF THE DRAWINGS

The foregoing and other features and advantages of the invention will be apparent from the following more particular description of preferred embodiments as illustrated in the accompanying drawings, in which reference characters refer to the same parts throughout the various views. The drawings are not necessarily to scale, emphasis instead being placed upon illustrating principles of the invention.

DETAILED DESCRIPTION

Figure 1:
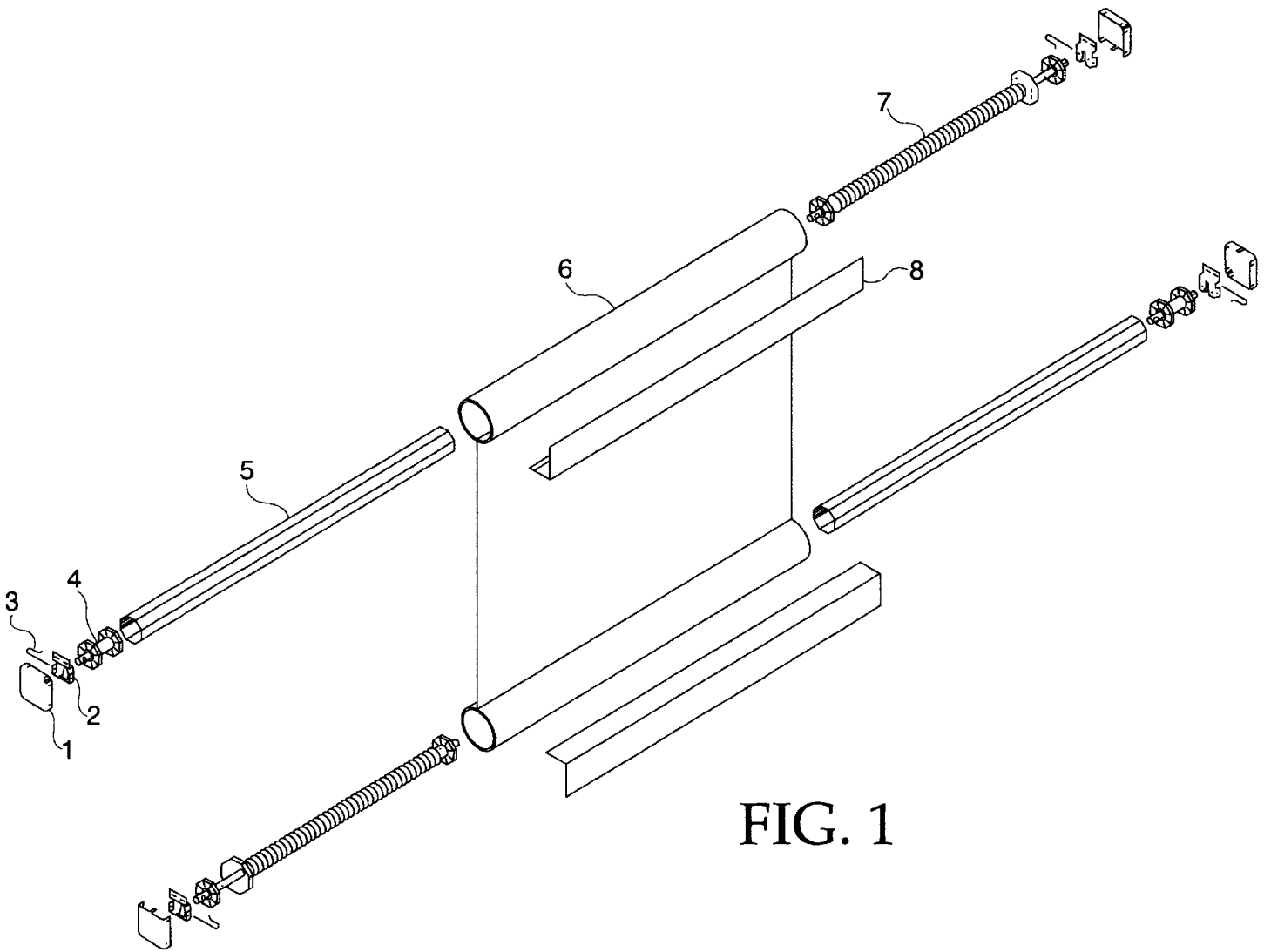
FIG. 1 is an exploded isometric view showing certain features of the invention according to a first embodiment.
Figure 2A:
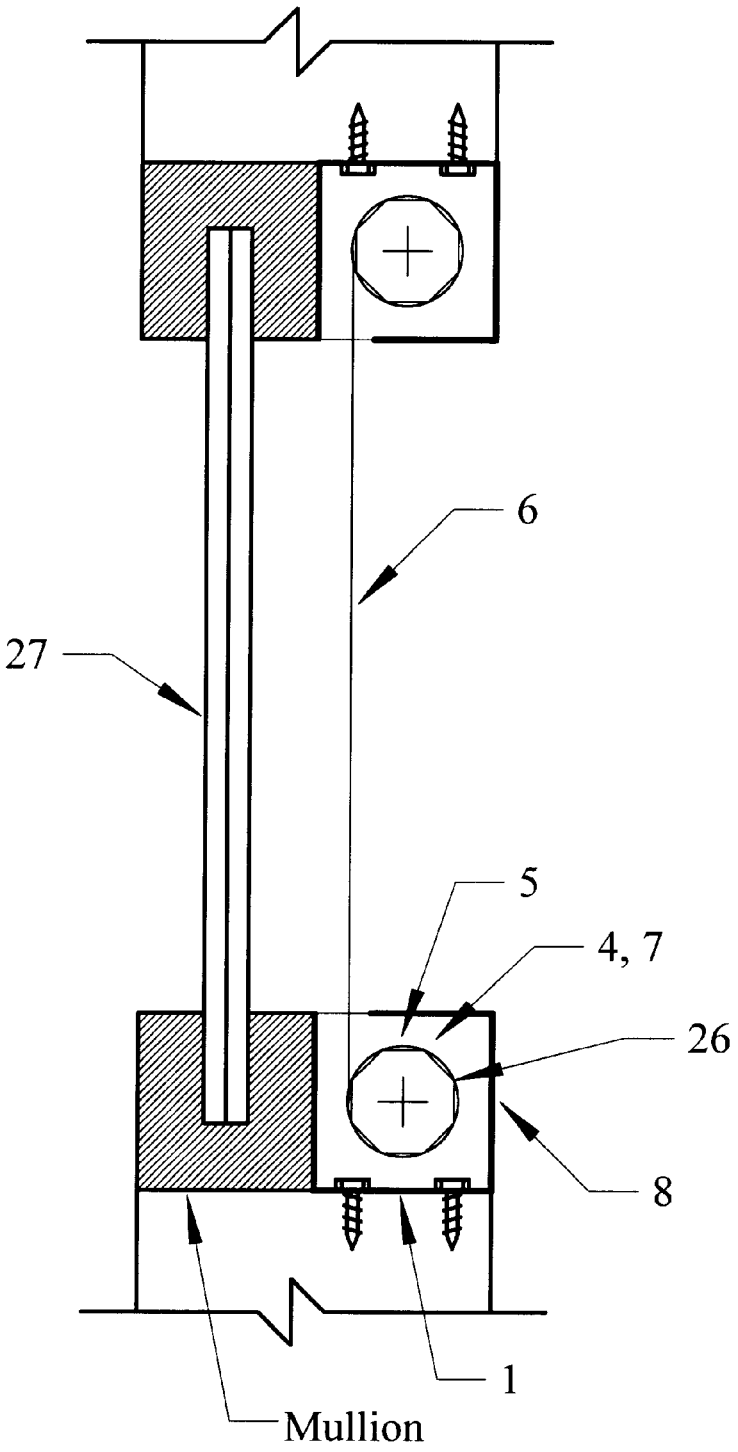
FIG. 2*a* is a vertical section showing certain features of the invention according to a first embodiment.
Figure 2B:
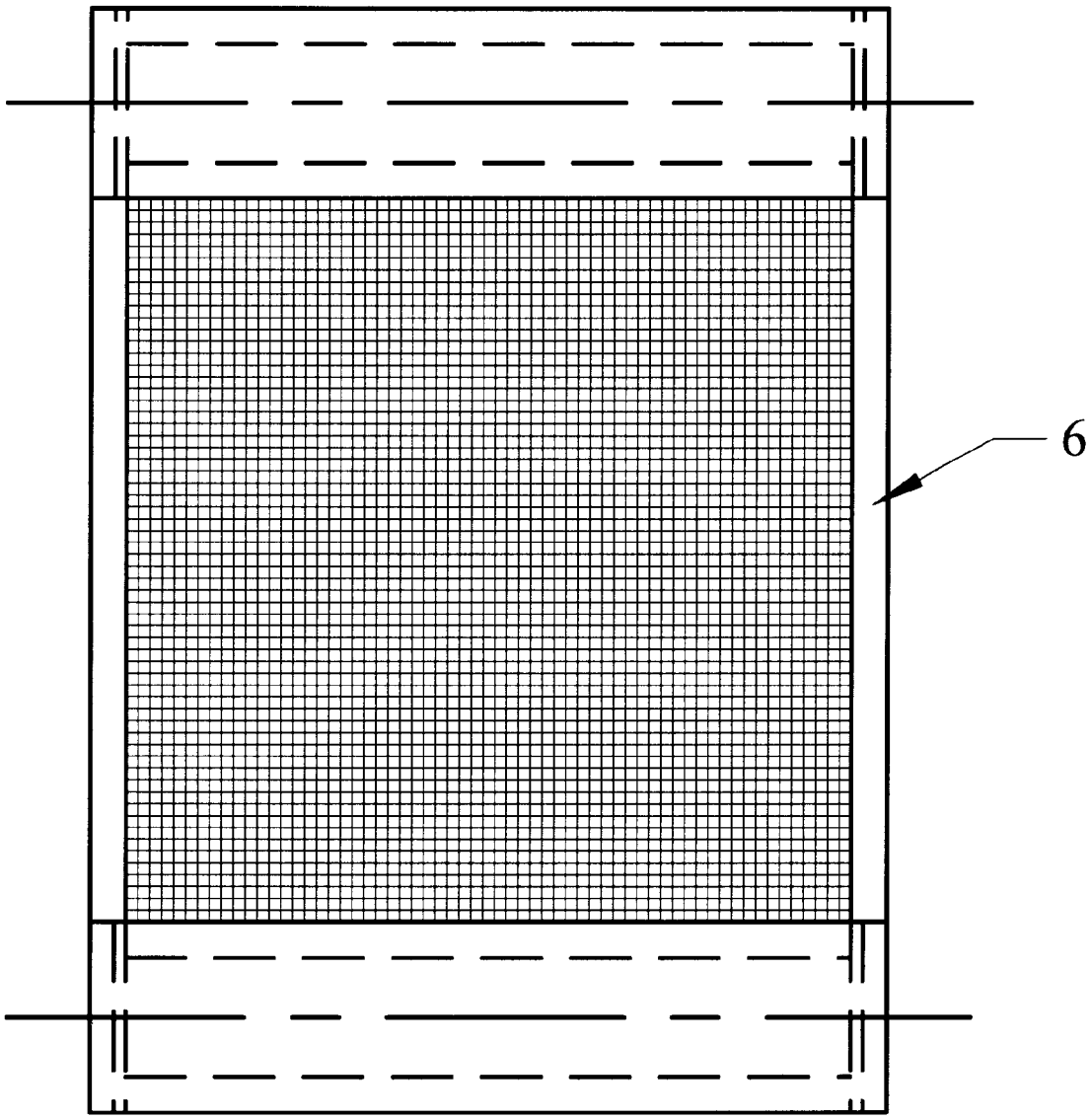
FIG. 2*b* is an elevation showing certain features of the invention according to a first embodiment.

With reference to FIGS. 1, 2*a,* and 2*b,* a protective window shield for blast mitigation is preferably installed at an interior location with respect to a glass window 27 of a building. A mounting configuration is detailed in FIGS. 2*a* and 2*b.* A blast-shielding panel 6 is retained at upper and lower positions by a dynamic retention system, which permits the fabric to unwind and billow out into the building, whereby flying glass and debris can be contained in the fabric. The dynamic tension retainers preferably have an approximate spring constant of 1.3 lb./in.

The retention system for the embodiment of FIGS. 1, 2*a,* and 2*b* preferably includes upper and lower dynamic tension retainers 7 to which a 10-inch retaining loop 26 is thermally bonded at each end of the blast-shielding panel 6. This retaining loop can be further secured to the dynamic tension retainers 7 by the blast-shielding panel enforcer bar (FIG. 3, reference no. 17) with screws. Each retainer case 5 preferably stores three revolutions of the blast-shielding panel 6 to allow for proper dynamic release and resistance.

The dynamic tension retainers 7 are pivotally mounted within the retainer case 5 which contains mounting brackets 1 that are securely fastened to a permanent building structural element by steel fasteners (see FIG. 2*a*). The mounting brackets 1 may be provided with a shaft lock 2 and shaft lock pin 3. Each dynamic tension retainer 7 preferably has a dual polymer construction and steel torsion bearer and 0.56" diameter shaft. A freewheel retainer 4 is provided within the retainer case 5. The retainer case is preferably of a high strength metallurgical alloy construction with a wall thickness of 0.04" and is capable of either an inside mount, outside mount, or ceiling mount. The retainer case 5 is mounted adjacent to the permanent building structural element by 0.0625 stainless steel aluminum alloy brackets 1, and may be provided with a decorative cover 8.

Figure 3:
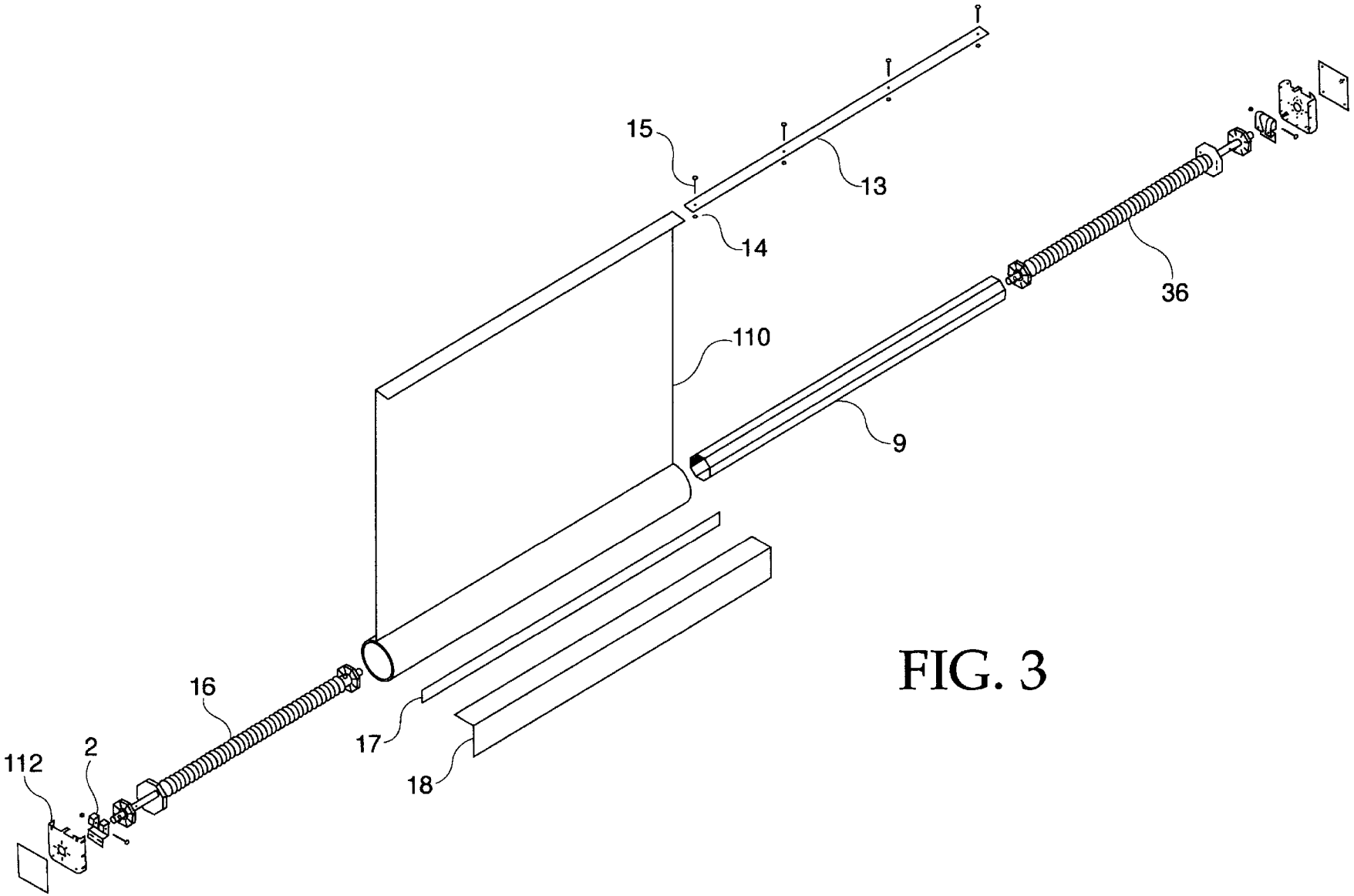
FIG. 3 is an exploded isometric view showing certain features of the invention according to a second embodiment.
Figure 4A:
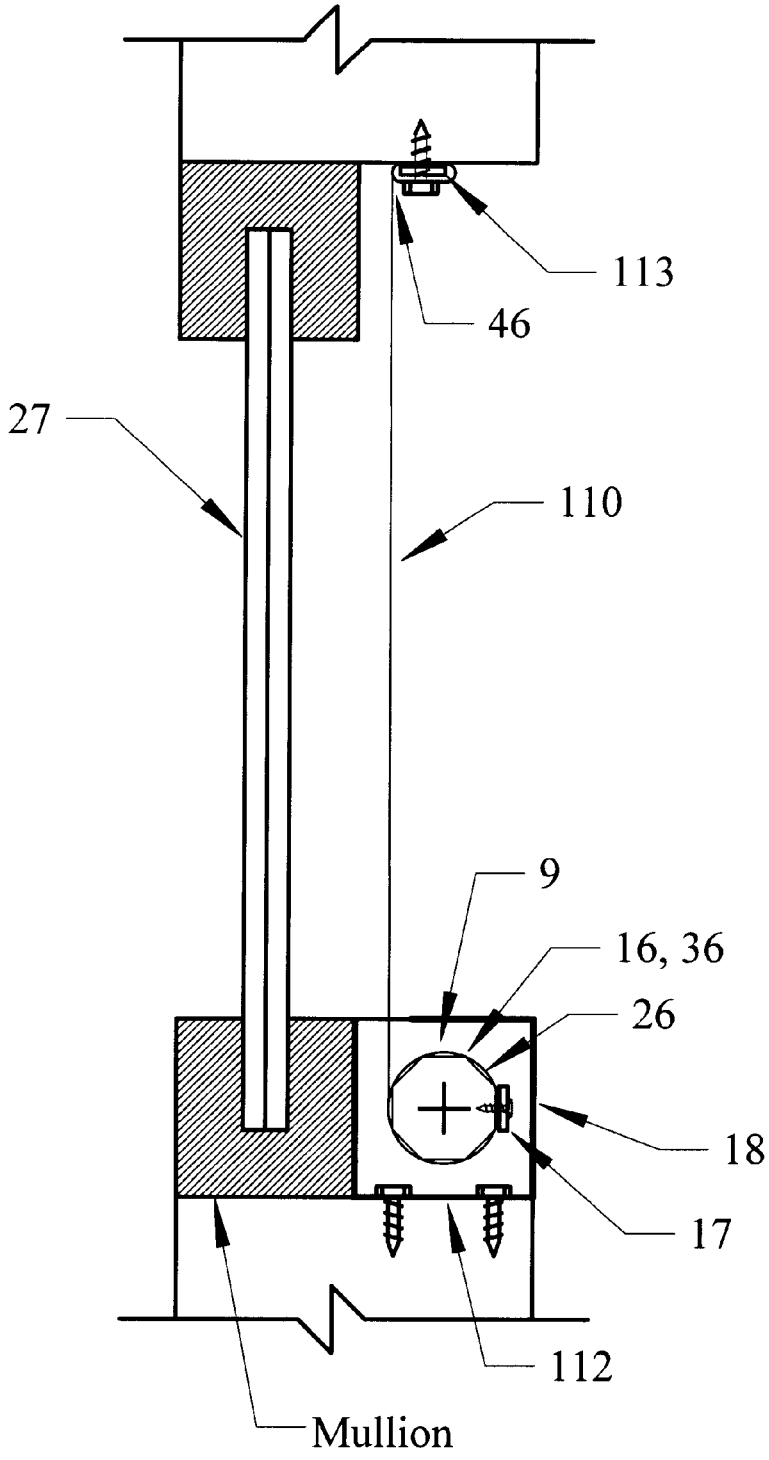
FIG. 4*a* is a vertical section showing certain features of the invention according to a second embodiment.
Figure 4B:
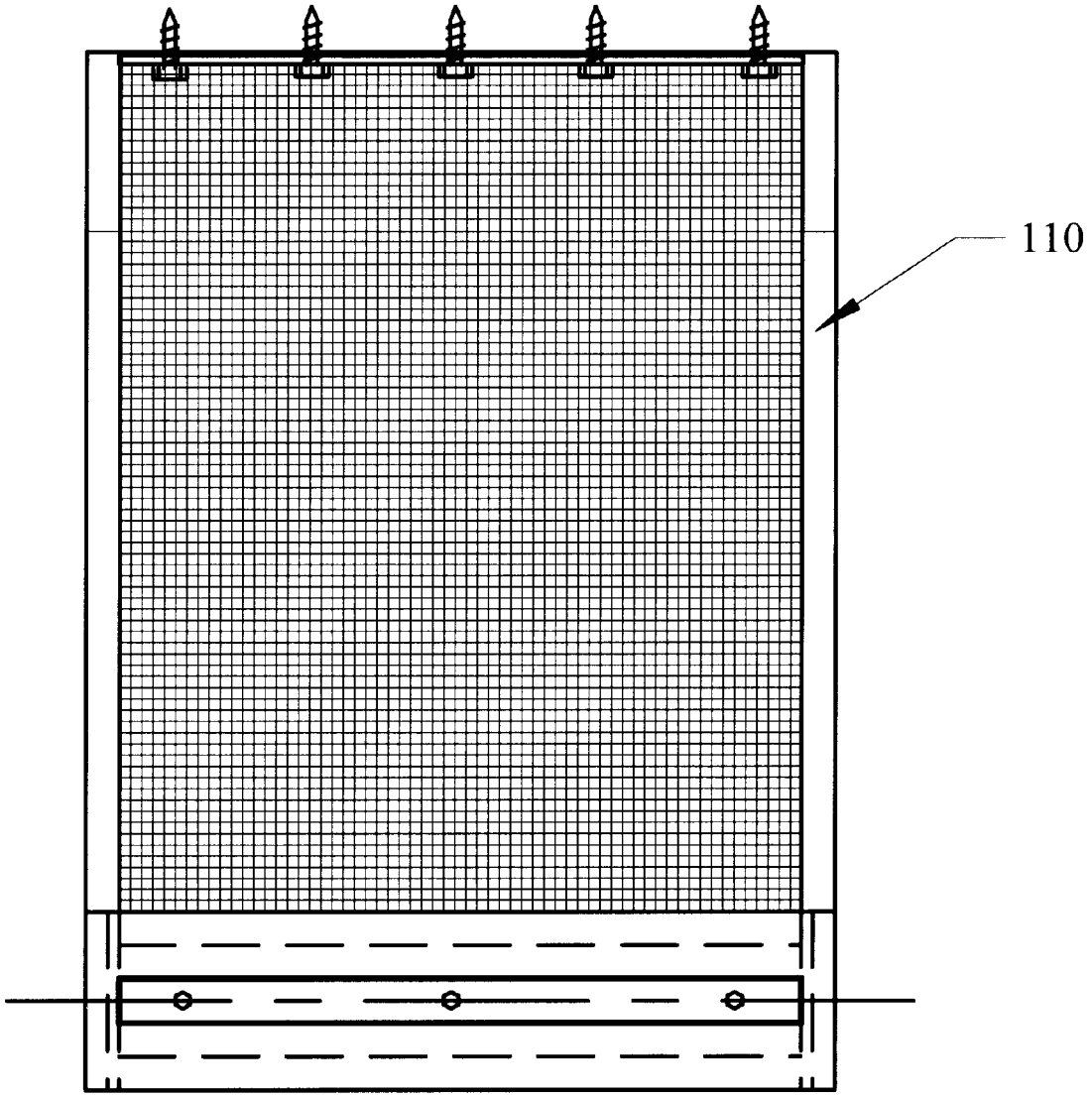
FIG. 4*b* is an elevation showing certain features of the invention according to a second embodiment.

FIG. 3 shows a second embodiment of the invention, and FIGS. 4*a* and 4*b* illustrate a mounting configuration for the second embodiment. A blast-shielding panel 110 is retained at the upper position by a blast-shielding panel enforcer bar 113, and at the lower position by a dual dynamic tension retainers 16, 36 which permits the fabric to unwind and billow out into the building, whereby flying glass and debris can be contained in the fabric.

The retention system for the embodiment of FIGS. 3, 4*a,* and 4*b* preferably includes an upper blast-shielding panel enforcer bar 113 that is secured to a permanent building structural element with fasteners 14, 15. The blast-shielding panel 110 is attached to the blast-shielding panel enforcer bar 113 by a thermally bonded retaining loop 46, which encloses the enforcer bar 113.

The retention system for the embodiment of FIGS. 3, 4*a,* and 4*b* preferably includes a lower dual dynamic tension retainer 16 to which a 10-inch retaining loop is thermally bonded to the blast-shielding panel 110. This retaining loop is further secured to the retainer case 9 by the blast-shielding panel enforcer bar 17 with screws. The retainer case 9 preferably stores five revolutions of the blast-shielding panel 110 to allow for proper dynamic release and resistance.

The dual dynamic tension retainer 16 is pivotally mounted within a retainer case 9 which includes mounting brackets 112 that are securely fastened to a permanent building structural element. The retainer case 9 is preferably of a high strength metallurgical alloy construction with a wall thickness of 0.04" and is capable of either an inside mount, outside mount, or ceiling mount. The retainer case 9 is mounted adjacent to the permanent building structural element by 0.0625" stainless steel brackets 112, and may be provided with a decorative cover 18.

Figure 5A:
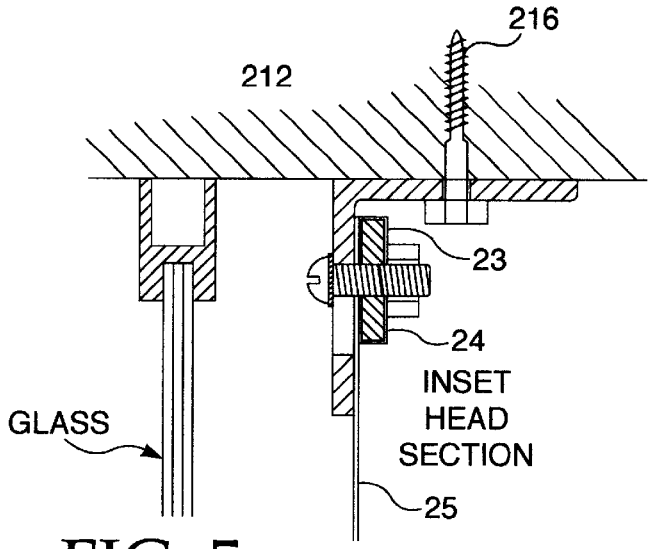
FIGS. 5*a* through 5*c* are a series of views showing certain features of a mounting system according to a third embodiment of the invention.
Figure 5B:
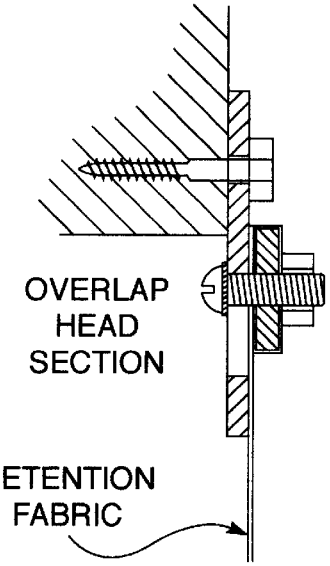
Figure 5C:
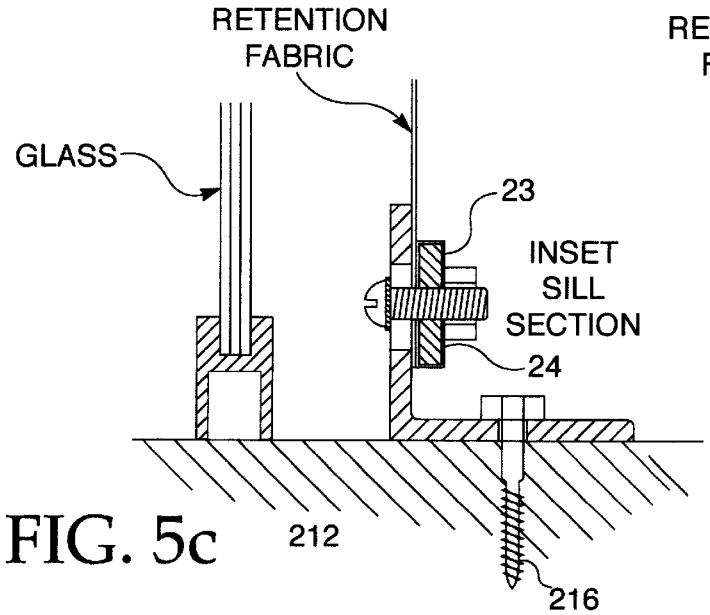

FIGS. 5*a* through 5*c* show the details of an embodiment in which a blast-shielding panel 25 is retained at upper and lower positions by blast-shielding panel enforcer bars 23 to which the blast-shielding panel 25 is attached at thermally bonded retaining loops 24. The blast-shielding panel enforcer bars 23 are attached to the permanent building structural elements 212 by screws 216.

The blast-shielding panel shown in FIGS. 1–5 preferably comprises a fabric which is woven from extrusion coated polyethylene fibers which have a tenacity of greater than 25 grams per denier and are heat-bonded for extra strength at each crossover so as not to unravel. A preferred embodiment utilizes such fibers as are commercially available from Allied Signal Corporation's "Spectra" product line (i.e. Spectra900, 1000, 2000), and are described in more detail in the literature entitled "Strength of a Diamond in a Fiber", the entire disclosure of which is incorporated herein by reference, although any suitable fiber of sufficient tensile strength may be used. Such fibers may be coated with a polymer formulated with performance additives, which withstand fading, mildew, soiling, and UV degradation.

The fibers are preferably woven into a double-strand, "full basket weave" mesh, 650 denier fabric that has a 25% openness configuration in the preferred application. Any open weave in the range of 1% to 30% is also envisioned. A 5% to 25% openness is preferred for providing significant light transmission while retaining high blast protection, with the degree of openness selected depending upon the desired blast protection balanced against the desired amount of light transmission through the fabric. The material thus woven is capable of transmitting a high degree of light while providing a high resistance to explosive blasts.

In operation, an exterior explosive blast causes glass and debris to be transmitted through a window opening. In the dynamic tension embodiments, the blast-shielding panel is caused to unwind from its retainers and billow out into the building, reaching a terminal panel tension of approximately 180 lb. at full extension, without becoming detached from the retainer case or from a surface to which the blast-shielding panel enforcer bars are mounted. Flying glass and debris are contained within the blast-shielding panel. For higher risk scenarios, high strength airline cable (not pictured) may be affixed between the wall and the dynamic tension retainers to retain the retainers as an added safety feature in the unlikely event that the dynamic tension retainers become detached from the mounting brackets during a blast.

The system depicted in FIGS. 1, 2*a,* and 2*b* can provide protection from flying glass and debris at low duration (<1 ms) blasts exceeding 35 psi peak pressure. The system depicted in FIGS. 3, 4*a,* and 4*b* can provide protection from flying glass and debris at blast impulses of up to 30 psi*ms (Level C, Condition 3 GSA protection rating).

The blast-shielding panel of the present invention provides the protection as set forth above while still permitting a high degree of light transmission and see-through visibility, thus preserving the view and natural lighting afforded by the window while providing daytime privacy. The blast-shielding panel also serves to control day lighting and reduces glare and heat gain, and can be used in combination with window glazing products.

While the invention has been particularly shown and described with reference to a preferred embodiment thereof, it will be understood by those skilled in the art that various changes in form and details may be made therein without departing from the spirit and scope of the invention.

The embodiments of the invention in which an exclusive property or privilege is claimed are defined as follows:

1. A blast-shielding system for interior portions of building windows, comprising:

a blast-shielding panel of a high tensile fiber woven into an open weave fabric in such a manner whereby a high degree of light is transmitted through the fabric to allow see-through visibility;

a dynamic retention system to which said blast-shielding panel is affixed, said dynamic retention system being operatively affixed to said interior portion and allowing the fabric to unwind and billow out into the building upon the impact of an exterior explosion, thereby retaining flying glass and debris caused by said explosion.

2. The blast-shielding system according to claim 1, wherein said dynamic retention system comprises a fixed tension retainer at one end of said panel and a dynamic tension retainer at an opposite end of said panel.

3. The blast-shielding system according to claim 2, wherein a length of said open-weave fabric is wound around said dynamic tension retainer and wherein said fabric is caused to unwind from said dynamic tension retainer upon said impact without becoming detached from a surface to which said retainer is mounted.

4. The blast-shielding system according to claim 1, wherein said dynamic retention system comprises an upper dynamic tension retainer at an upper end of said panel and a lower dynamic tension retainer at a lower end of said panel.

5. The blast-shielding system according to claim 1, wherein said high tensile fiber comprises a fiber having a tenacity of greater than 25 grams per denier.

6. The blast-shielding system according to claim 5, wherein said fiber comprises extrusion coated polyethylene fibers which are heat-bonded for extra strength at each crossover so as not to unravel.

7. A blast-shielding system for interior portions of building windows, comprising:

a blast-shielding panel of a high tensile fiber woven into an open weave fabric in such a manner whereby a high degree of light is transmitted through the fabric to allow see-through visibility;

said blast-shielding panel being operatively affixed to said interior portion by fixed upper and lower tension retainers, thereby retaining flying glass and debris caused by said explosion.

* * * * *